US009776390B2

(12) United States Patent
Jung

(10) Patent No.: US 9,776,390 B2
(45) Date of Patent: Oct. 3, 2017

(54) HYBRID TRANSFER MACHINE

(71) Applicant: KYUNGIL-TECH CO., LTD., Gyeongsangnam-do (KR)

(72) Inventor: Soon-Tae Jung, Gyeongsangnam-do (KR)

(73) Assignee: KYUNGIL-TECH CO., LTD., Gyeongsangnam-Do (KR)

( * ) Notice: Subject to any disclaimer, the term of this patent is extended or adjusted under 35 U.S.C. 154(b) by 103 days.

(21) Appl. No.: 14/970,826

(22) Filed: Dec. 16, 2015

(65) Prior Publication Data

US 2017/0144431 A1 May 25, 2017

(30) Foreign Application Priority Data

Nov. 23, 2015 (KR) ..... 10-2015-0163782

(51) Int. Cl.
*B41F 16/02* (2006.01)

(52) U.S. Cl.
CPC ..... *B41F 16/02* (2013.01)

(58) Field of Classification Search
CPC ..... B41F 16/02
See application file for complete search history.

(56) References Cited

U.S. PATENT DOCUMENTS 3,768,280 A * 10/1973 Kannegiesser ..... B41F 17/00 101/132
5,943,952 A * 8/1999 Monti ..... B41F 16/02 101/33

FOREIGN PATENT DOCUMENTS

KR 20110026779 3/2011
KR 101135531 4/2012

* cited by examiner

*Primary Examiner* — Joshua D Zimmerman
(74) *Attorney, Agent, or Firm* — IPLA P.A.; James E. Bame

(57) ABSTRACT

A hybrid transfer machine includes a body, a fabric supply drum driving means, a fabric detection sensor, a take-up transfer paper drum driving means, a thermal transfer unit, a piece-mode roller, a take-up main drum driving means, a main guide roller, and a roll-mode roller. The body includes a first body, a second body, and a worktable. The fabric supply drum driving means drives a fabric supply drum. The fabric detection sensor detects fabric, and controls an operation. The take-up transfer paper drum driving means drives the take-up transfer paper drum. The thermal transfer unit heats the fabric and transfer paper. The piece-mode roller rotatably guides the transfer paper. The take-up main drum driving means drives the take-up fabric drum or take-up transfer paper drum. The main guide roller guides the transfer paper or the fabric. The roll-mode roller guides the transfer paper.

3 Claims, 3 Drawing Sheets

HYBRID TRANSFER MACHINE

CROSS REFERENCE

This application claims foreign priority under Paris Convention to Korean Patent Application No. 10-2015-0163782, filed 23 Nov. 2015, with the Korean Intellectual Property Office.

BACKGROUND

The present invention relates generally to hybrid transfer machine, and more particularly to a hybrid transfer machine that can select and use piece mode and roll mode as desired by using a single apparatus.

In general, various patterns are chiefly printed on fabrics, such as those used for handkerchiefs, clothing, etc., using a transfer printing method.

Such a transfer printing method is a printing method in which transfer paper with a specific pattern or photo is laid on printing target fabric, and a heating roller heated to an appropriate temperature is moved in a direction in the state of pressing the transfer paper and the fabric together so that they come into close contact with each other, thereby transferring the pattern or photo on the transfer paper to the fabric.

In general, a transfer printing machine is configured such that a supply roller, a tension roller, a discharge roller and a plurality of idle rollers are disposed in front of, below, above and behind a heating roller, respectively, a belt is disposed such that the outside surface of the belt surrounds the periphery of the heating roller and the inside surface of the belt is moved over the supply roller, the tension roller, the discharge roller and the plurality of idle rollers in a close contact state, and then transfer paper and fabric are supplied between the heating roller and the belt in a stacked state, thereby realizing transfer printing.

Such transfer printing machines may be classified into roll-type machines and piece-type machines. A roll-type method is a method for automatically and continuously supplying fabric and transfer paper, and a piece-type method is a method for automatically supplying transfer paper and supplying pieces of fabric.

Meanwhile, conventionally, since both a roll-type transfer machine and a piece-type transfer machine should be purchased, operating costs are high and space utilization is considerably less efficient because the two machines are arranged in a single space.

Reference 1. Korean Patent Application Publication No. 10-2011-0026779 (entitled "Transfer Fabric Manufacturing Machine," and published on Mar. 16, 2011)

Reference 2. Korean Patent No. 10-1135531 (entitled "Transfer Printing Machine for Automatically Feeding Transfer Paper," and published on Apr. 4, 2012)

SUMMARY OF THE INVENTION

Accordingly, the present invention has been made keeping in mind the above problems occurring in the prior art, and an object of the present invention is to provide a hybrid transfer machine that can select and use piece mode and roll mode as desired, thereby significantly improving versatility, space utilization and operation efficiency.

In accordance with an aspect of the present invention, there is provided a hybrid transfer machine, including:

a body including: a first body including a transfer paper supply drum installation portion, a fabric supply drum installation portion, and a take-up transfer paper drum installation portion; a second body including a take-up main drum installation portion; and a worktable installed such that both ends of the worktable are installed on the first body and the second body, respectively;

a fabric supply drum driving means installed on the first body, and configured to drive a fabric supply drum rotatably installed on the fabric supply drum installation portion;

a fabric detection sensor installed on the first body, and configured to detect fabric and control the operation of the fabric supply drum driving means;

a take-up transfer paper drum driving means installed on the first body, and configured to drive the take-up transfer paper drum rotatably installed on the take-up fabric drum installation portion;

a thermal transfer unit installed on the second body, and configured to heat the fabric and transfer paper supplied from the worktable, thereby transferring the print target of the transfer paper to the fabric;

a piece-mode roller rotatably installed on the second body, and configured to guide the transfer paper, supplied from the main guide roller, to the take-up main drum installation portion;

a take-up main drum driving means installed on the second body, and configured to drive the take-up fabric drum or take-up transfer paper drum rotatably installed on the take-up main drum installation portion;

a main guide roller rotatably installed on the second body, and configured to guide the transfer paper, supplied from the thermal transfer unit, to the piece-mode roller or to guide the fabric, supplied from the thermal transfer unit, to the take-up main drum installation portion; and a roll-mode roller rotatably installed on the second body, and configured to guide the transfer paper, supplied from the thermal transfer unit, to the take-up transfer paper drum installation portion.

The hybrid transfer machine may further include a tension adjuster installed on the first body such that the fabric passes through the tension adjuster, and configured to adjust tension, applied to the fabric, to a predetermined magnitude.

A tissue supply drum installation portion and a take-up tissue drum installation portion may be additionally provided in the second body; a take-up tissue drum driving means installed in the second body and configured to drive a take-up tissue drum rotatably installed on the take-up tissue drum installation portion may be additionally provided; and the main guide roller may receive tissue, having entered the thermal transfer unit, from the thermal transfer unit, and may guide the tissue to the take-up tissue drum installation portion.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

The present invention will be described in detail with reference to the accompanying drawings.

It should be noted that the present invention is mainly characterized in that piece mode (a first embodiment) for supplying pieces of fabric F and transferring a print target to the pieces of fabric F and roll mode (a second embodiment) for continuously supplying roll-type fabric F and transferring a print target to the roll-type fabric F can be selected and used as desired.

Figure 1:
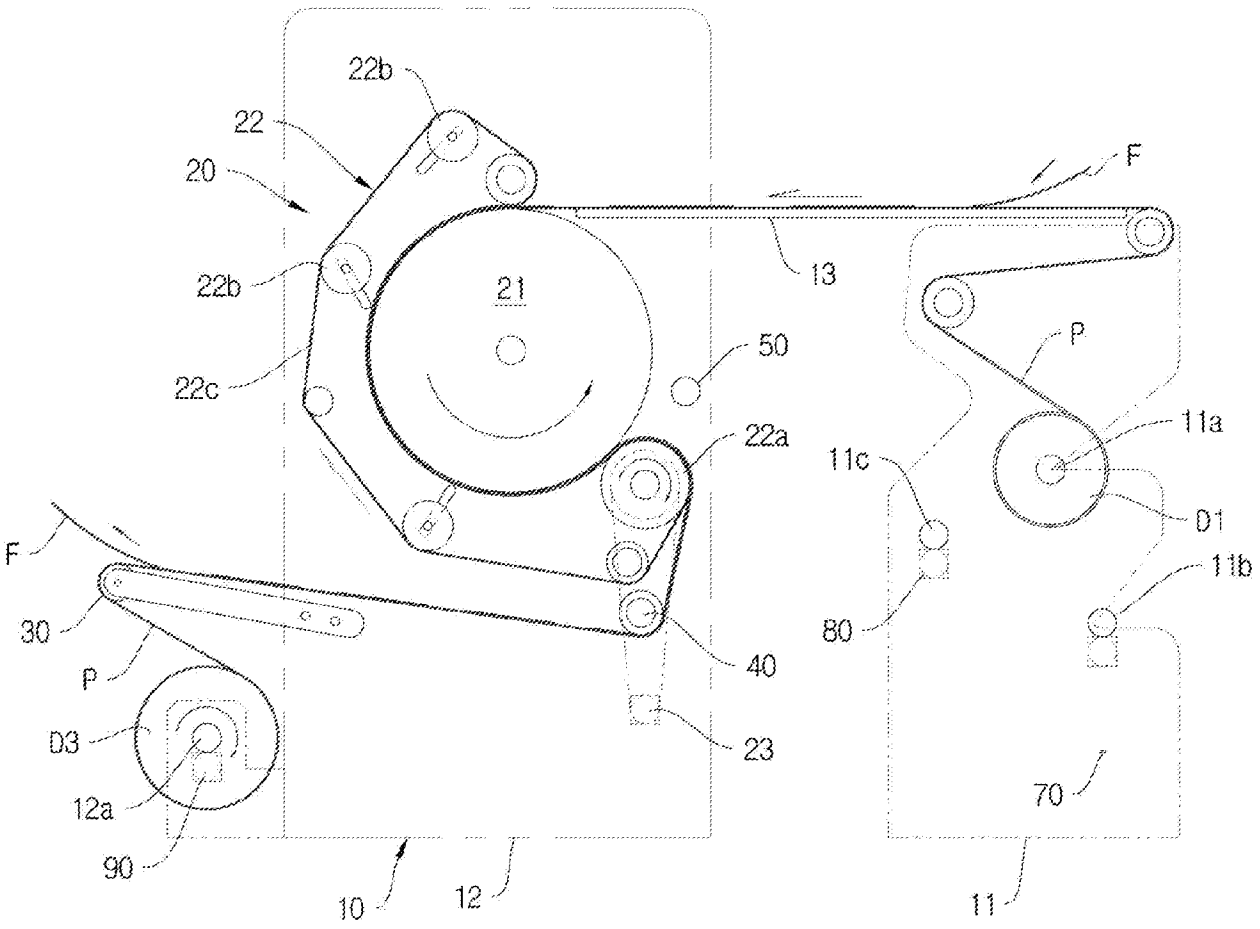
FIG. 1 is a diagram showing a hybrid transfer machine according to a first embodiment of the present invention.

FIG. 1 is a diagram showing a hybrid transfer machine according to a first embodiment (piece mode) of the present invention.

Referring to FIG. 1, the hybrid transfer machine according to the first embodiment of the present invention includes a body 10, a thermal transfer unit 20, a piece-mode roller 30, a main guide roller 40, and a take-up main drum driving means 90.

Referring to FIG. 1, the body 10 includes a first body 11, a second body 12, and a worktable 13.

The first body 11 is composed of a pair of plates, and includes a transfer paper supply drum installation portion 11*a*, a fabric supply drum installation portion 11*b*, and a take-up transfer paper drum installation portion 11*c*.

The second body 12 is also composed of a pair of plates spaced apart from each other, and includes a take-up main drum installation portion 12*a*.

The worktable 13 is disposed between and connects the first and second bodies 11 and 12, more accurately between the upper portions of the first and second bodies 11 and 12.

Referring to FIG. 1, the thermal transfer unit 20 includes a heating drum 21, a close contact mechanism 22, and a drive pulley driving means 23, and is installed in the second body 12. In the case of the present embodiment, the thermal transfer unit 20 functions to allow the print target of transfer paper P to be transferred to fabric F by applying heat to the transfer paper P and the fabric F, having entering a space between the heating drum 21 and the close contact mechanism 22, while pressing them, and then to discharge them.

The heating drum 21 contains a heater (not shown) therein, and is rotatably installed in the second body 12 in the case of the present embodiment.

The close contact mechanism 22 is disposed adjacent to the heating drum 21 around the heating drum 21, and includes a drive pulley 22*a* and driven pulleys 22*b* configured to receive power from the drive pulley driving means 23, and to be driven, and a belt 22*c* configured to surround the drive pulley 22*a* and the driven pulleys 22*b*, to transfer power from the drive pulley 22*a* to the driven pulleys 22*b*, to come into close contact with the peripheral surface of the heating drum 21, and to rotate the heating drum 21.

The drive pulley driving means 23 is a servo motor, and is coupled to the drive pulley 22*a* via a coupling means (for example, a belt, a chain, or the like) and functions to drive the drive pulley 22*a*.

According to the present embodiment, the drive pulley 22*a* receives power from the drive pulley driving means 23 and is driven by the power, the belt 22*c* passed over the drive pulley 22*a* is rotated by the rotation of the drive pulley 22*a*, and accordingly the driven pulleys 22*b* coupled to the drive pulley 22*a* via the belt 22*c* are rotated.

Furthermore, as the belt 22*c* is rotated, the heating drum 21 in contact with the belt 22*c* is also rotated.

For reference, it is preferable that some of the driven pulleys 22*b* are configured to be movable in order to adjust the spacing between the belt 22*c* and the heating drum 21.

Meanwhile, the drive pulley driving means 23 is not coupled to the drive pulley 22*a*, unlike in the conventional case, but may be modified to be coupled to the heating drum 21 via a coupling means (for example, a belt, a chain, or the like) and to rotate the heating drum 21, thereby rotating the belt 22*c* using frictional force.

Referring to FIG. 1, the piece-mode roller 30 is rotatably installed on the second body 12, and functions to guide the transfer paper P, supplied from the thermal transfer unit 20, to the take-up main drum installation portion 12*a*.

In the case of the present embodiment, the piece-mode roller 30 is rotatably installed at an end of a support protruding from the second body 12.

Referring to FIG. 1, the main guide roller 40 is rotatably installed in the second body 12, and functions to guide the transfer paper P, supplied from the thermal transfer unit 20, to the piece-mode roller 30 or to guide the fabric F, supplied from the thermal transfer unit 20, to the take-up main drum installation portion 12*a*.

According to the present embodiment, the piece-mode roller 30 is supplied with the transfer paper P from the main guide roller 40, and guides the transfer paper P to the take-up main drum installation portion 12*a*. When fabric F is also transferred while the transfer paper P is being guided, the transfer paper P naturally performs a conveyer function.

Meanwhile, a collection box configured to receive the fabric F falling while the transfer paper P and the fabric F are passing over the piece-mode roller 30 may be installed in the second body 12.

The take-up main drum driving means 90 is a servo motor. In the present embodiment, the take-up main drum driving means 90 is installed on the second body 12, and functions to drive a take-up fabric drum D4 or take-up transfer paper drum D3 rotatably installed on the take-up main drum installation portion 12*a*.

In the present embodiment, as the transfer paper P is guided by the main guide roller 40 and the piece-mode roller 30, the take-up transfer paper drum D3 is rotatably installed on the take-up main drum installation portion 12*a*.

The operation of the hybrid transfer machine according to the first embodiment (piece mode), configured as described above, is described below.

First, after the transfer paper supply drum D1 around which the transfer paper P is wound has been placed on the transfer paper supply drum installation portion 11*a* of the first body 11, the transfer paper P is disposed to pass over the worktable 13, pass through the thermal transfer unit 20 and pass over the main guide roller 40 and the piece-mode roller 30, and is then wound around the take-up transfer paper drum D3.

When power is applied to the drive pulley driving means 23 and the take-up main drum driving means 90 in the state in which the transfer paper P is disposed as described above, the heater drum 21 and the close contact mechanism 22 are rotated by the drive pulley driving means 23 in the state in which they are in contact with each other, the take-up transfer paper drum D3 is driven by the main drum driving means 90 and simultaneously and gradually winds the transfer paper P around itself, with the result that the transfer paper supply drum D1 is rotated and simultaneously unwinds the transfer paper P from itself.

Meanwhile, pieces of fabric F are placed on the top surface of the transfer paper P moving along the worktable 13 and move along with the transfer paper P, and the overlapping transfer paper P and fabric F enter the thermal transfer unit 20.

As the transfer paper P and the fabric F having entered the thermal transfer unit 20 are pressed and heated by the heater drum 21 and the close contact mechanism 22, the print target of the transfer paper P is transferred to the fabric F, and the transfer paper P and the fabric F pass through the thermal transfer unit 20, pass over the main guide roller 40, and is then supplied to the piece-mode roller 30.

In this case, since the transfer paper P supplied from the main guide roller 40 to the piece-mode roller 30 functions as a type of conveyer, the fabric F is transferred via the transfer paper P, the transferred fabric F is separated from the transfer paper P, and the transfer paper P passes over the piece-mode roller 30 and is wound around the take-up transfer paper drum D3.

Figure 2:
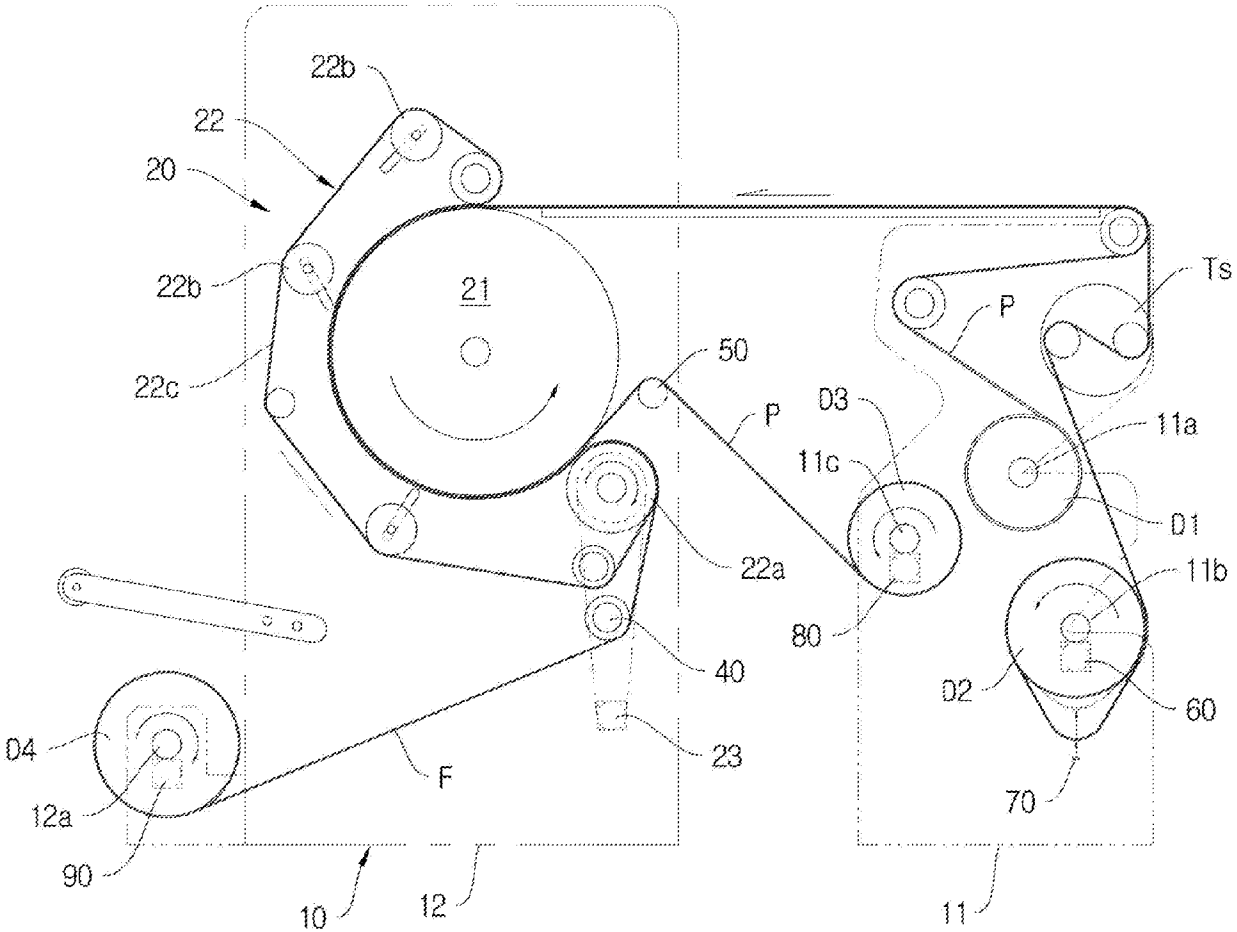
FIG. 2 is a diagram showing a hybrid transfer machine according to a second embodiment of the present invention.

Meanwhile, the hybrid transfer machine according to the present invention may be switched to roll mode, which is shown in FIG. 2.

FIG. 2 is a diagram showing a hybrid transfer machine according to a second embodiment (roll mode) of the present invention.

In the hybrid transfer machine according to the second embodiment (roll mode) of the present invention, a roll-mode roller 50, a fabric supply drum driving means 60, a fabric detection sensor 70 and a take-up transfer paper drum driving means 80 are added to the configuration of the above-described first embodiment, a take-up fabric drum D4 is installed on the take-up main drum installation portion 12*a* instead of the take-up transfer paper drum D3, and the take-up transfer paper drum D3 is installed on the take-up transfer paper drum installation portion 11*c*.

Referring to FIG. 2, the roll-mode roller 50 is rotatably installed on the second body 12, and functions to guide transfer paper P, supplied from the thermal transfer unit 20, to the take-up transfer paper drum installation portion 11*c*.

Referring to FIG. 2, the fabric supply drum driving means 60 is a servo motor. In the present embodiment, the fabric supply drum driving means 60 is installed on the first body 11, and functions to drive a fabric supply drum D2 rotatably installed on a fabric supply drum installation portion 11*b*.

Referring to FIG. 2, the fabric detection sensor 70 is installed on the first body 11, and functions to detect fabric F and control the operation of the fabric supply drum driving means 60.

As an example, when the fabric supply drum D2 is rotated by the fabric supply drum driving means 60, the fabric F wound around the fabric supply drum D2 is gradually unwound and droops, and the fabric detection sensor 70 detects the distance to the drooped fabric F.

In this case, when the distance to the fabric F falls within a predetermined distance, the fabric supply drum driving means 60 does not operate. In contrast, when the distance to the fabric F does not fall within the predetermined distance, the fabric detection sensor 70 outputs a detection signal to the fabric supply drum driving means 60, and the fabric supply drum driving means 60 receives this signal and rotates the fabric supply drum D2 until the fabric detection sensor 70 and the fabric F are located within a predetermined distance, thereby unwinding the fabric F.

Accordingly, the present embodiment has the advantage of preventing excessive tension from occurring in the fabric F and the advantage of preventing deformation from occurring due to extension and contraction because the fabric F wound around the fabric supply drum D2 is always supplied in the state of drooping to a predetermined length by the fabric supply drum driving means 60 and the fabric detection sensor 70.

Meanwhile, a well-known tension adjuster Ts is installed on the first body 11. The fabric F is installed to pass through the tension adjuster Ts, and functions to adjust tension, applied to the fabric F, to a predetermined magnitude.

Referring to FIG. 2, the take-up transfer paper drum driving means 80 is a servo motor. In the present embodiment, the take-up transfer paper drum driving means 80 is installed on the first body 11, and functions to drive the take-up transfer paper drum D3 rotatably installed on the take-up fabric drum installation portion 11*c*.

The operation of the hybrid transfer machine according to the second embodiment (roll mode), configured as described above, is described below.

First, after the transfer paper supply drum D1 around which the transfer paper P is wound has been placed on the transfer paper supply drum installation portion 11*a* of the first body 11, the transfer paper P is disposed to pass over the worktable 13, pass through the thermal transfer unit 20 and pass over the roll-mode roller 50, and is then wound around the take-up transfer paper drum D3 rotatably installed on the take-up transfer paper drum installation portion 11*c*.

Furthermore, after the fabric supply drum D2 around which the fabric F is wound is placed on the fabric supply drum installation portion 11*b* of the first body 11, the fabric F is disposed to pass through the tension adjuster Ts, pass over the worktable 13, pass through the thermal transfer unit 20 and pass over the main guide roller 40, and is wound around the take-up fabric drum D4 rotatably installed on the take-up main drum installation portion 12*a*.

When power is applied in the state in which the above settings have been made, operation is performed by the driving means. This is described in greater detail below.

First, the heater drum 21 and the close contact mechanism 22 are rotated by the drive pulley driving means 23 in the state in which they are in contact with each other.

Furthermore, the take-up transfer paper drum D3 is driven by the take-up transfer paper drum driving means 80 and simultaneously and gradually winds the transfer paper P around itself, with the result that the transfer paper supply drum D1 is rotated and simultaneously unwinds the transfer paper P from itself.

Furthermore, as the fabric supply drum D2 is driven by the fabric supply drum driving means 60, the fabric F wound around the fabric supply drum D2 and droops, in which case the fabric detection sensor 70 detects the distance to the fabric F, and controls the operation of the fabric supply drum driving means 60.

Furthermore, as the take-up fabric drum D4 is driven by the take-up main drum driving means 90, the fabric F is gradually wound, with the result that the unwound fabric F is transferred to the worktable 13 through the tension adjuster Ts.

The transfer paper P and the fabric F having moved along the worktable 13 enters the thermal transfer unit 20. The transfer paper P and the fabric F having entered the thermal transfer unit 20 are pressed and heated by the heater drum 21 and the close contact mechanism 22, and thus the print target of the transfer paper P is transferred to the fabric F. The transfer paper P passes through the thermal transfer unit 20, passes over the roll-mode roller 50 and is then wound around the take-up transfer paper drum D3, and the fabric F passes through the thermal transfer unit 20, passes over the main guide roller 40 and is then wound around the take-up fabric drum D4.

Meanwhile, as the fabric F is continuously supplied, the distance between the fabric F drooped to a predetermined length and the fabric detection sensor 70 gradually increases. When the distance exceeds the predetermined distance, the fabric detection sensor 70 outputs a detection signal to the fabric supply drum driving means 60. The fabric supply drum driving means 60 receives the detection signal, and rotates the fabric supply drum D2 until the detection sensor 70 and the fabric F are located within a predetermined distance, thereby unwinding the fabric F.

Accordingly, the present embodiment has the advantage of preventing excessive tension from occurring in the fabric F and the advantage of preventing deformation from occurring due to extension and contraction because the fabric F wound around the fabric supply drum D2 is always supplied in the state of drooping to a predetermined length by the fabric supply drum driving means 60 and the fabric detection sensor 70.

According to the present embodiment, the advantages of significantly improving versatility, space utilization and operation efficiency can be achieved in that piece-mode (the first embodiment) for supplying pieces of fabric F and transferring a print target to the pieces of fabric F and roll mode (the second embodiment) for continuously supplying roll-type fabric F and transferring a print target to the roll-type fabric F can be selected and used as desired.

Furthermore, the advantages of enabling compact manufacturing and reducing manufacturing costs can be achieved in that components are appropriately arranged and used in the empty spaces of the first body 11 and the second body 12 without extending an existing body 10.

Figure 3:
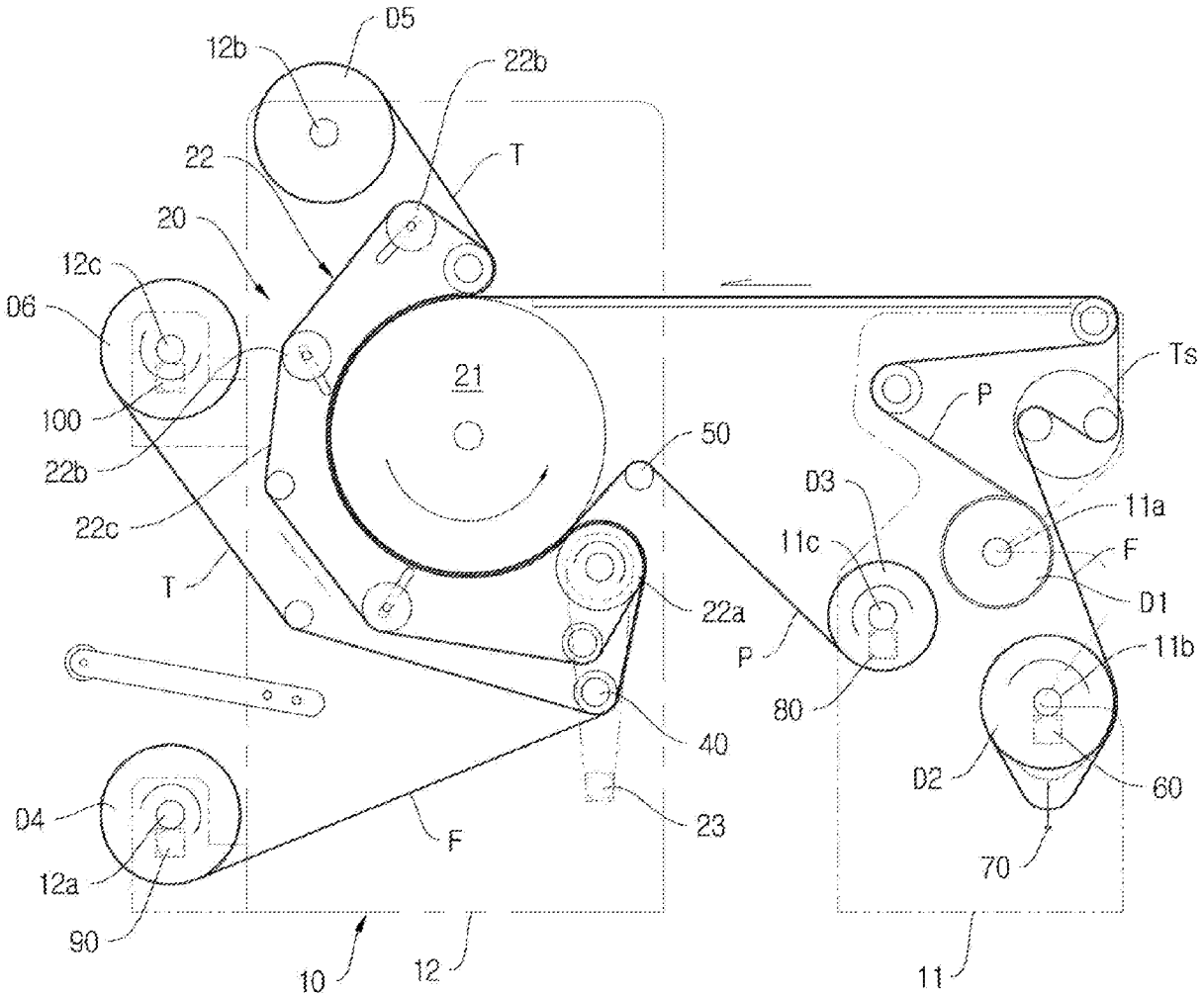
FIG. 3 is a diagram showing a hybrid transfer machine according to a third embodiment of the present invention.

FIG. 3 is a diagram showing a hybrid transfer machine according to a third embodiment of the present invention.

The construction of the third embodiment of the present invention is substantially the same as the configuration of the above-described second embodiment. They differ from each other in that a tissue supply drum installation portion 12*b*, a take-up tissue drum installation portion 12*c*, and a take-up tissue drum driving means 100 are added.

Referring to FIG. 3, the tissue supply drum installation portion 12*b* and the take-up tissue drum installation portion 12*c* are provided in a second body 12.

A tissue supply drum D5 around which tissue T is wound is rotatably installed on the tissue supply drum installation portion 12*b*, and a take-up tissue drum D6 configured to wind the tissue T is rotatably installed on the take-up tissue drum installation portion 12*c*.

The take-up tissue drum driving means 100 is a servo motor. In the present embodiment, the take-up tissue drum driving means 100 is installed on the second body 12, and functions to drive a take-up tissue drum D6 rotatably installed on the take-up tissue drum installation portion 12*c*.

In this case, the main guide roller 40 functions to receive the tissue T, having entered the thermal transfer unit 20, from the thermal transfer unit 20, and to guide the tissue T to the take-up tissue drum installation portion 12*c*.

In this case, the tissue T is disposed between the fabric F and the belt 22*c* of the thermal transfer unit 20, and functions to prevent the belt 22*c* from being contaminated.

As an example, in the thermal transfer unit 20, the print target of the transfer paper P is transferred to (printed on) the fabric F. In this process, when the chemical components of the print target pass through the fabric F, the belt 22*c* may be contaminated with the chemical components, with the result that a serious problem occurs in that the fabric F is also contaminated, thus resulting in the production of a number of defective products.

Accordingly, it is preferred that when the fabric F and the transfer paper P be supplied to the thermal transfer unit 20, the tissue T is also supplied, thereby preventing the belt 22*c* from being contaminated.

As an example, when the take-up tissue drum driving means 100 is operated in the state in which the tissue T wound around the tissue supply drum D5 is passed through the thermal transfer unit 20, passed over the main guide roller 40, and wound around the take-up tissue drum D6, the tissue T is gradually wound around the take-up tissue drum D6, and the tissue T wound around the tissue supply drum D5 is gradually unwound and supplied.

Meanwhile, although in the present embodiment, the drive pulley driving means 23, the take-up transfer paper drum driving means 80, the take-up main drum driving means 90 and the take-up tissue drum driving means 100 have been illustrated and described as being separately driven, this is merely an embodiment. For example, this may be modified such that the above driving means are driven using a single power source.

According to the present embodiment, the advantages of significantly improving versatility, space utilization and operation efficiency can be achieved in that piece-mode (the first embodiment) for supplying pieces of fabric F and transferring a print target to the pieces of fabric F and roll mode (the second embodiment) for continuously supplying roll-type fabric F and transferring a print target to the roll-type fabric F can be selected and used as desired.

Furthermore, the advantages of enabling compact manufacturing and reducing manufacturing costs can be achieved in that components are appropriately arranged and used in the empty spaces of the first body and the second body without extending and raising an existing body.

Furthermore, the advantage of preventing excessive tension from occurring in fabric can be achieved in that fabric is supplied in the state of drooping by the fabric supply drum driving means and the fabric detection sensor.

Moreover, an advantage is achieved in that tissue is supplied while fabric and transfer paper are being supplied to the thermal transfer unit, and thus a contamination source passing through the fabric is absorbed into the tissue, with the result that the belt is prevented from being contaminated and thus the problem in which the fabric is contaminated with the contamination source is fundamentally overcome, thereby significantly reducing the production of defective products.

Although the present invention has been described in detail with reference to specific embodiments, it will be apparent to those skilled in the art that various modifications and variations may be made within the scope and technical spirit of the present invention. Furthermore, it will be apparent to those skilled in the art that these modifications and variations fall within the attached claims.

What is claimed is:

1. A hybrid transfer machine, comprising:

a body comprising:

a first body including a transfer paper supply drum installation portion, a fabric supply drum installation portion, and a take-up transfer paper drum installation portion;

a second body including a take-up main drum installation portion; and a worktable installed such that both ends of the worktable are installed on the first body and the second body, respectively;

a fabric supply drum driving means installed on the first body, and configured to drive a fabric supply drum rotatably installed on the fabric supply drum installation portion;

a fabric detection sensor installed on the first body, and configured to detect fabric and control an operation of the fabric supply drum driving means;

a take-up transfer paper drum driving means installed on the first body;

a thermal transfer unit installed on the second body, and configured to heat the fabric and transfer paper supplied from the worktable, thereby transferring a print target of the transfer paper to the fabric;

a piece-mode roller rotatably installed on the second body;

a take-up main drum driving means installed on the second body, and configured to drive the take-up main drum;

a main guide roller rotatably installed on the second body; and a roll-mode roller rotatably installed on the second body wherein, when the hybrid transfer machine is in a piece mode:

a take-up transfer paper drum is rotatably installed on the take-up main drum;

the main-guide roller guides the take-up transfer paper to the piece-mode roller; and the piece-mode roller guides the transfer paper to the take up main drum installation portion;

wherein, when the hybrid transfer machine is in a roll-mode:

a take-up fabric drum is rotatably installed on the take-up main drum;

a take-up transfer paper drum is rotatably installed on the take-up fabric drum installation portion;

the main-guide roller guides the fabric to the take-up main drum installation portion;

the roll-mode roller guides the transfer paper, supplied from the thermal transfer unit, to the take-up transfer paper drum installation portion; and the take-up transfer paper drum driving means drives the take-up transfer paper drum.

2. The hybrid transfer machine of claim 1, further comprising a tension adjuster installed on the first body such that the fabric passes through the tension adjuster, and configured to adjust tension, applied to the fabric, to a predetermined magnitude.

3. The hybrid transfer machine of claim 1, wherein:

a tissue supply drum installation portion and a take-up tissue drum installation portion are additionally provided in the second body;

a take-up tissue drum driving means installed in the second body and configured to drive a take-up tissue drum rotatably installed on the take-up tissue drum installation portion is additionally provided; and the main guide roller receives tissue, having entered the thermal transfer unit, from the thermal transfer unit, and guides the tissue to the take-up tissue drum installation portion.

* * * * *